US010698351B1

(12) United States Patent
Himeno

(10) Patent No.: US 10,698,351 B1
(45) Date of Patent: Jun. 30, 2020

(54) FIXING DEVICE AND IMAGE FORMING APPARATUS

(71) Applicant: TOSHIBA TEC KABUSHIKI KAISHA, Shinagawa-ku, Tokyo (JP)

(72) Inventor: Satoshi Himeno, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/504,432

(22) Filed: Jul. 8, 2019

(30) Foreign Application Priority Data

Dec. 19, 2018 (JP) ..... 2018-237568

(51) Int. Cl.
*G03G 15/20* (2006.01)

(52) U.S. Cl.
CPC ..... *G03G 15/2053* (2013.01); *G03G 15/206* (2013.01); *G03G 15/2028* (2013.01); *G03G 15/2064* (2013.01)

(58) Field of Classification Search
CPC ..... G03G 15/2053; G03G 15/2028
See application file for complete search history.

(56) References Cited

U.S. PATENT DOCUMENTS 4,440,486 A * 4/1984 Isaka ..... G03G 15/2092 219/216
8,395,090 B2 3/2013 Chiyoda
2005/0047838 A1* 3/2005 Uehara ..... G03G 15/20 399/329
2008/0260425 A1* 10/2008 Hirayama ..... G03G 15/2053 399/122
2009/0297201 A1* 12/2009 Ono ..... G03G 15/2053 399/88
2011/0008082 A1* 1/2011 Nanno ..... G03G 15/2053 399/329
2011/0222886 A1* 9/2011 Tsukioka ..... G03G 15/5029 399/68
2011/0305474 A1* 12/2011 Tanaka ..... G03G 15/2053 399/69

FOREIGN PATENT DOCUMENTS

JP 2012083692 A * 4/2012

* cited by examiner

*Primary Examiner* — Sevan A Aydin

(74) *Attorney, Agent, or Firm* — Amin, Turocy & Watson, LLP

(57) ABSTRACT

In accordance with an embodiment, a fixing device comprises a fixing belt configured to heat a toner image on a sheet to which the toner image is attached to fix the toner image to the sheet using heat; a heating roller, arranged to internally contact the fixing belt to carry the fixing belt, configured to heat the fixing belt; and a plurality of support rollers each configured to abut against a portion that does not abut against the fixing belt at an end in a longitudinal direction of the heating roller to support the heating roller, and have an outer diameter smaller than that of the portion that does not abut against the fixing belt.

20 Claims, 9 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2018-237568, filed Dec. 19, 2018, the entire contents of which are incorporated herein by reference.

FIELD

Embodiments described herein relate generally to a fixing device and an image forming apparatus.

BACKGROUND

An image forming apparatus includes a fixing device. The fixing device fixes a toner image to a sheet by heating and pressing the toner image. The fixing device has a heating roller. The heating roller heats the toner image. The heating roller has a hollow cylindrical core and a heater. The heater is inserted to the inside of the core.

The heating roller is rotationally driven. The heating roller is rotatably supported by side plates of the fixing device at both ends of the core. At both ends of the core, bearings are fitted via heat insulating bushes. Such a bearing needs to have an inner diameter at least capable of being fitted into an outer side of the heat insulating bush fitted into the core. Since such a large-diameter bearing is close to a heating source, specifications having resistance to the high temperature are required. On the other hand, since an outer diameter of the core is determined according to a size of the heater arranged in the core, it is difficult to further reduce the size of the outer diameter of the core.

The large-diameter bearing for rotatably supporting the heating roller results in a large scale of the fixing device. Furthermore, the bearing with the large diameter and heat resistance is expensive, which is one of the reasons why the fixing device becomes expensive.

DETAILED DESCRIPTION

Figure 1:
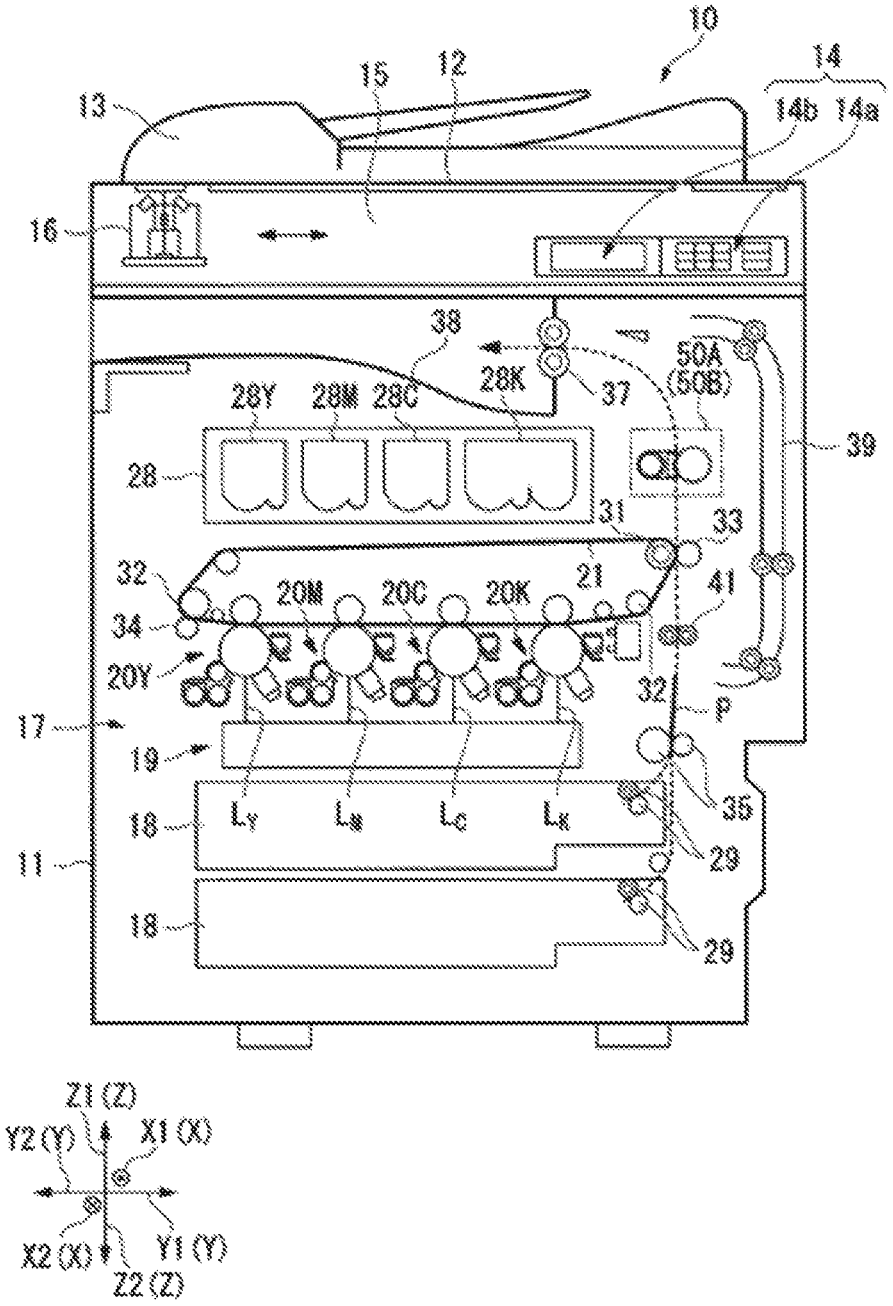
FIG. 1 is a schematic cross-sectional view illustrating a configuration of an image forming apparatus according to a first embodiment.

In accordance with an embodiment, a fixing device comprises a fixing belt configured to heat a toner image on a sheet to which the toner image is attached to fix the toner image to the sheet using heat; a heating roller, arranged to internally contact the fixing belt to carry the fixing belt, configured to heat the fixing belt; and a plurality of support rollers each configured to abut against a portion that does not abut against the fixing belt at an end in a longitudinal direction of the heating roller to support the heating roller, and have an outer diameter smaller than that of the portion that does not abut against the fixing belt.

Hereinafter, a fixing device and an image forming apparatus according to several embodiments are described with reference to the accompanying drawings. In each figure, the same components are denoted with the same reference numerals.

First Embodiment

An image forming apparatus and a fixing device of the first embodiment are described.

FIG. 1 is a schematic cross-sectional view illustrating a configuration of an image forming apparatus according to the first embodiment.

As shown in FIG. 1, the image forming apparatus 10 of the first embodiment is, for example, an MFP (Multi-Function Peripheral), a printer, a copying machine, and the like. An example in which the image forming apparatus 10 is an MFP is described below.

At the top of a main body 11 of the image forming apparatus 10, a document table 12 having a transparent glass is arranged. An ADF (Automatic Document Feeder) 13 is arranged on the document table 12. At the top of the main body 11, an operation section 14 is arranged. The operation section 14 includes an operation panel 14*a* having various keys and a touch panel type display section 14*b*.

A scanner section 15 serving as a reading device is arranged below the ADF 13. The scanner section 15 reads a document fed by the ADF 13 or a document placed on the document table 12. The scanner section 15 generates image data of the document. For example, the scanner section 15 includes an image sensor 16. For example, the image sensor 16 may be a contact type image sensor.

The image sensor 16 moves along the document table 12 at the time of reading the image on the document placed on the document table 12. The image sensor 16 reads a document image by each line for one page of the document.

If the image on the document fed by the ADF 13 is read, the image sensor 16 reads the fed document at a fixed position shown in FIG. 1.

The main body 11 of the image forming apparatus 10 has a printer section 17 at a center in a height direction thereof. The main body 11 has a plurality of sheet feed cassettes 18 at the bottom thereof.

The plurality of sheet feed cassettes 18 accommodates sheets P of various sizes. The plurality of sheet feed cassettes 18 accommodates the sheets P of various sizes in accordance with a center reference. A central axis of a width in a direction orthogonal to a conveyance direction of each of the sheets P of various sizes is positioned at a fixed position.

The sheet feed cassette 18 is provided with a sheet feed mechanism 29. The sheet feed mechanism 29 picks up the sheets P one by one from the sheet feed cassette 18 and feeds it to a conveyance path. For example, the sheet feed mechanism 29 may include a pickup roller, a separation roller and a sheet feed roller.

Hereinafter, in the image forming apparatus 10, a direction orthogonal to the conveyance direction of the sheet P along a conveyance surface of the sheet P is referred to as a "conveyance orthogonal direction".

Below, as shown in FIG. 1, an X direction, a Y direction and a Z direction are defined based on the arrangement of the image forming apparatus 10 placed on the horizontal plane.

The X direction indicates the conveyance orthogonal direction in the image forming apparatus 10. In particular, in the conveyance orthogonal direction, a direction from a rear surface of the image forming apparatus 10 towards a front surface on which the operation section 14 is arranged may be referred to as an X1 direction, and an opposite direction thereof may be referred to as an X2 direction. In each of the constitutive elements of the image forming apparatus 10, a position (element) away from the center in the X direction in the X1 direction may be referred to as a front side position (element). Similarly, a position (element) away from the center in the X2 direction may be referred to as a rear side position (element).

The Y direction is orthogonal to the X direction in the horizontal plane. When the front surface of the image forming apparatus 10 is oriented towards the X2 direction, the Y direction from the left to the right may be referred to as a Y1 direction, and an opposite direction thereof may be referred to as a Y2 direction.

The Z direction is orthogonal to the X direction and the Y direction. The Z direction coincides with a vertical direction. A vertically upward direction may be referred to as a Z1 direction, and an opposite direction thereof may be referred to as a Z2 direction.

The printer section 17 forms an image on the sheet P based on image data read by the scanner section 15 or image data created by a personal computer. The printer section 17 is a color printer of a tandem system, for example.

The printer section 17 includes image forming sections 20Y, 20M, 20C and 20K of yellow (Y), magenta (M), cyan (C) and black (K) colors, an exposure device 19 and an intermediate transfer belt 21.

The image forming sections 20Y, 20M, 20C and 20K are arranged side by side below the intermediate transfer belt 21. The image forming sections 20Y, 20M, 20C and 20K are arranged in order in a direction from an upstream side to a downstream side in a moving direction (Y1 direction) at the lower side of the intermediate transfer belt 21.

The exposure device 19 emits exposure light LY, LM, LC and LK to the image forming sections 20Y, 20M, 20C and 20K, respectively.

The exposure device 19 may generate a laser scanning beam as the exposure light. The exposure device 19 may include a solid-state scanning element such as an LED (Light-Emitting Diode) for emitting the exposure light.

The configurations of the image forming sections 20Y, 20M, 20C and 20K are common to each other except that the color of the toner is different. Either one of a normal color toner and a decolorable toner may be used as the toner. The decolorable toner becomes transparent if heated at a certain temperature or higher.

The image forming sections 20Y, 20M, 20C and 20K each have a photoconductive drum. The photoconductive drum is an image carrier. A charging device, a developing device, a primary transfer roller, a cleaner and a blade are arranged around the photoconductive drum along a rotation direction of the photoconductive drum.

The charging device uniformly charges the surface of the photoconductive drum.

The exposure device 19 generates the exposure light LY, LM, LC and LK modulated based on the image data. The exposure light exposes the surface of the photoconductive drum of each of the image forming sections 20Y, 20M, 20C and 20K. The exposure device 19 forms an electrostatic latent image on each photoconductive drum.

The developing device supplies each toner to each photoconductor accordingly by a developing roller to which a developing bias is applied. The developing device develops the electrostatic latent image on each photoconductive drum.

The cleaner has a blade abutting against the photoconductive drum. The blade removes residual toner on the surface of the photoconductive drum.

As shown in FIG. 1, at the top of the image forming sections 20Y, 20M, 20C and 20K, a toner cartridge 28 is arranged.

The toner cartridge 28 supplies the toner to the developing device of each of the image forming sections 20Y, 20M, 20C and 20K, respectively. The toner cartridge 28 has toner cartridges 28Y, 28M, 28C and 28K.

The intermediate transfer belt 21 moves cyclically. The intermediate transfer belt 21 is wrapped around a drive roller 31 and a plurality of the driven rollers 32. The intermediate transfer belt 21 is in contact with the respective photoconductive drums of the image forming sections 20Y, 20M, 20C and 20K from the upper side in FIG. 1.

A primary transfer roller is arranged on the inner side of the intermediate transfer belt 21 to face each of the photoconductive drums in the intermediate transfer belt 21.

Each primary transfer roller primarily transfers the toner image on each photoconductive drum onto the intermediate transfer belt 21 when the primary transfer voltage is applied.

A secondary transfer roller 33 faces the drive roller 31 across the intermediate transfer belt 21. An abutting portion between the intermediate transfer belt 21 and the secondary transfer roller 33 constitutes a secondary transfer position.

A secondary transfer voltage is applied to the secondary transfer roller 33 at the time the sheet P passes through the secondary transfer position. If the secondary transfer voltage is applied to the secondary transfer roller 33, the secondary transfer roller 33 secondarily transfers the toner image on the intermediate transfer belt 21 onto the sheet P.

A belt cleaner 34 is arranged in the vicinity of the driven roller 32. The belt cleaner 34 removes the transfer toner left on the intermediate transfer belt 21 from the intermediate transfer belt 21.

A sheet feed roller 35 and a registration roller 41 are arranged on a conveyance path from the sheet feed cassette 18 to the secondary transfer roller 33. The sheet feed roller 35 conveys the sheet P taken out of the sheet feed cassette 18 by the sheet feed mechanism 29. The registration roller 41 aligns a position of a tip of the sheet P fed from the sheet feed roller 35 at a mutual abutting position thereof. If the tip of the toner image reaches the secondary transfer position, the registration roller 41 conveys the sheet P such that a tip of a transfer area of the toner image on the sheet P reaches the secondary transfer position. The transfer area of the toner image is an area excluding a formation area with blank edge on the sheet P.

On the downstream side (upper side in FIG. 1) of the secondary transfer roller 33 in the conveyance direction of the sheet P, a fixing device 50A is arranged in the printer section 17.

A conveyance roller 37 is arranged on the downstream side (upper left side in FIG. 1) of the fixing device 50A in the conveyance direction of the sheet P. The conveyance roller 37 discharges the sheet P to a sheet discharge section 38.

An inversion conveyance path 39 is arranged on the downstream side (right side in FIG. 1) of the fixing device 50A in the conveyance direction of the sheet P. The inversion conveyance path 39 is used to reverse the sheet P to guide it to the secondary transfer roller 33. The inversion conveyance path 39 is used for duplex printing.

The fixing device 50A is described in detail below.

Figure 2:
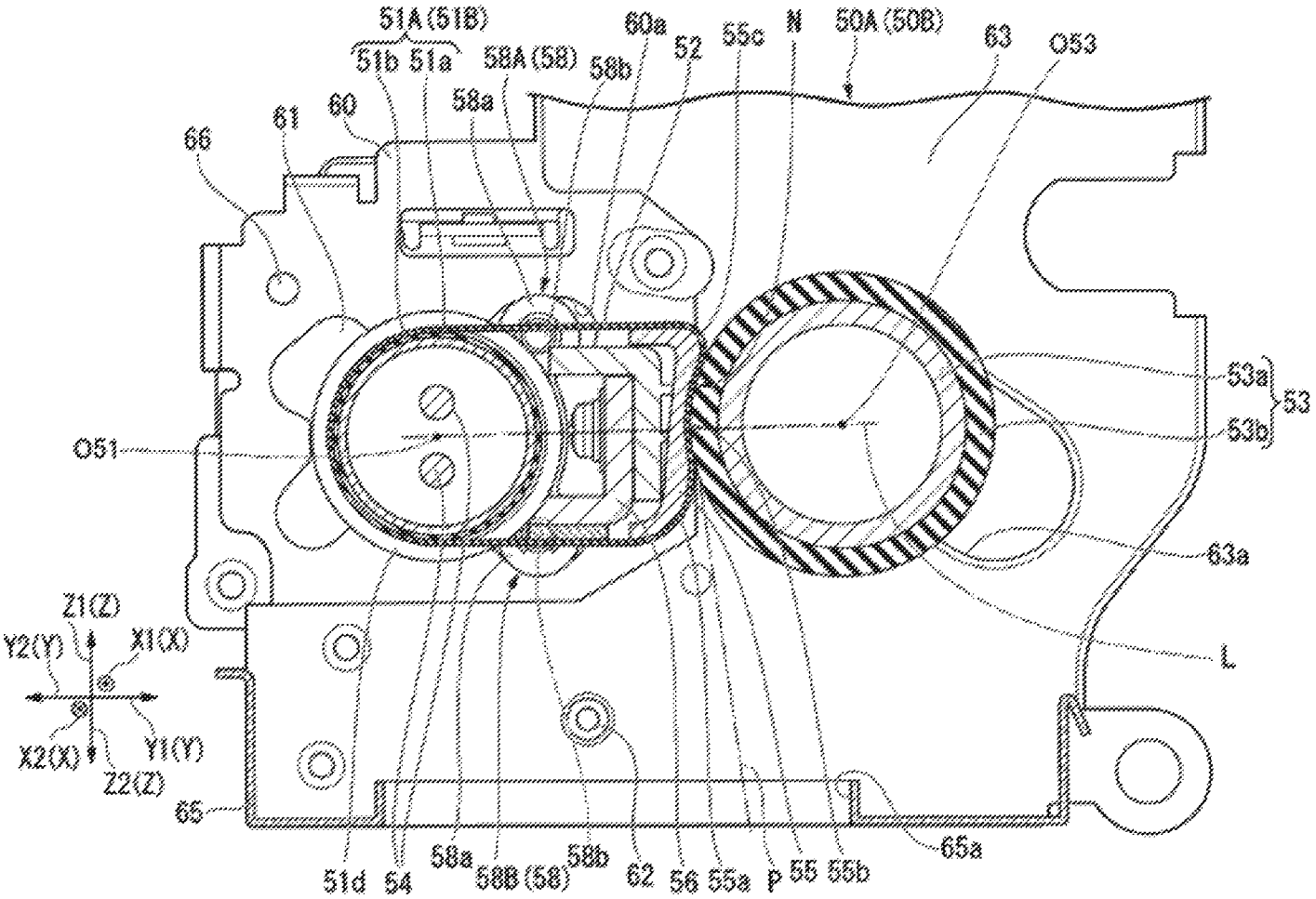
FIG. 2 is a schematic cross-sectional view illustrating a configuration of a fixing device according to the first embodiment.
Figure 3:
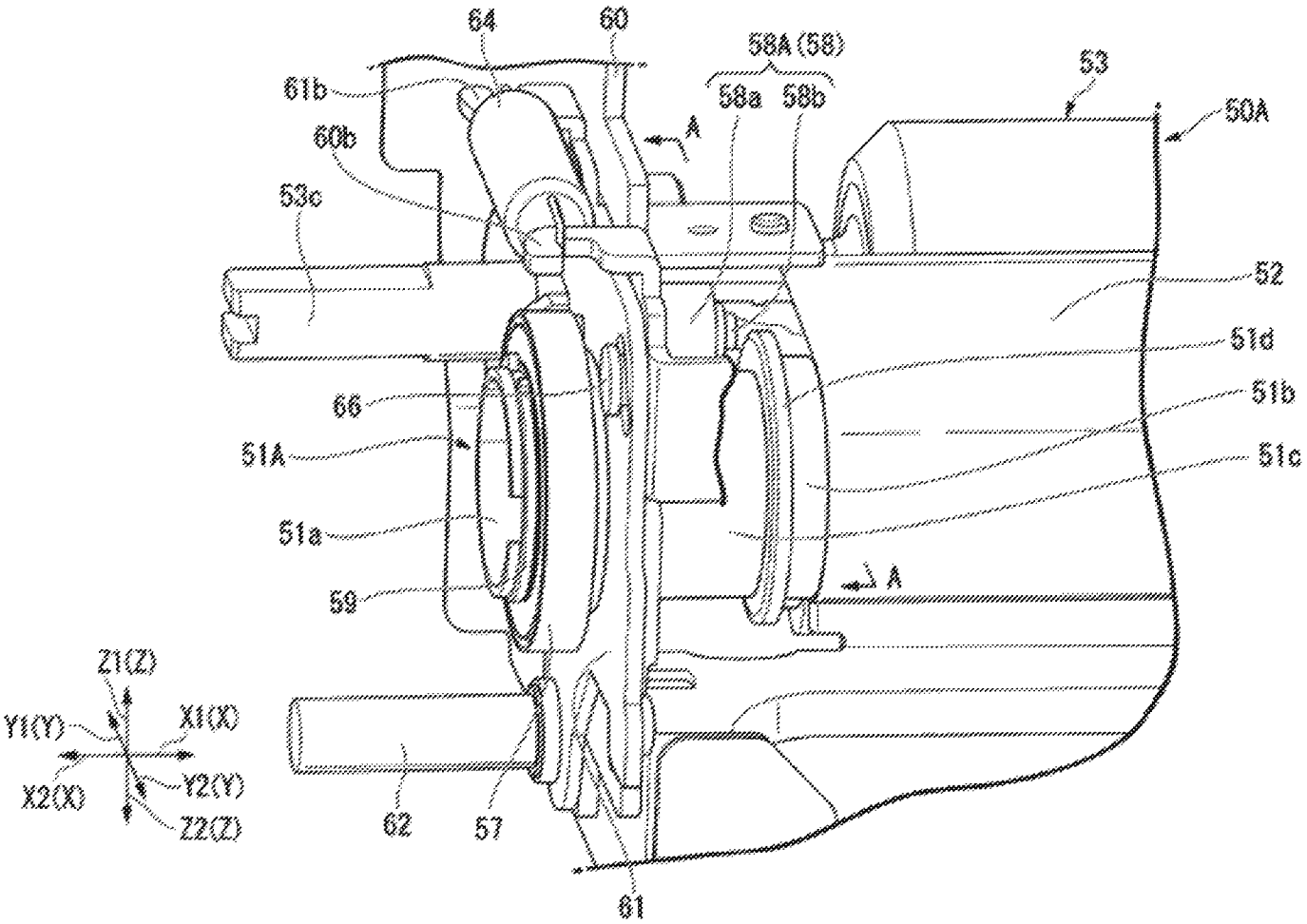
FIG. 3 is a schematic perspective view illustrating a configuration of the fixing device according to the first embodiment.
Figure 4:
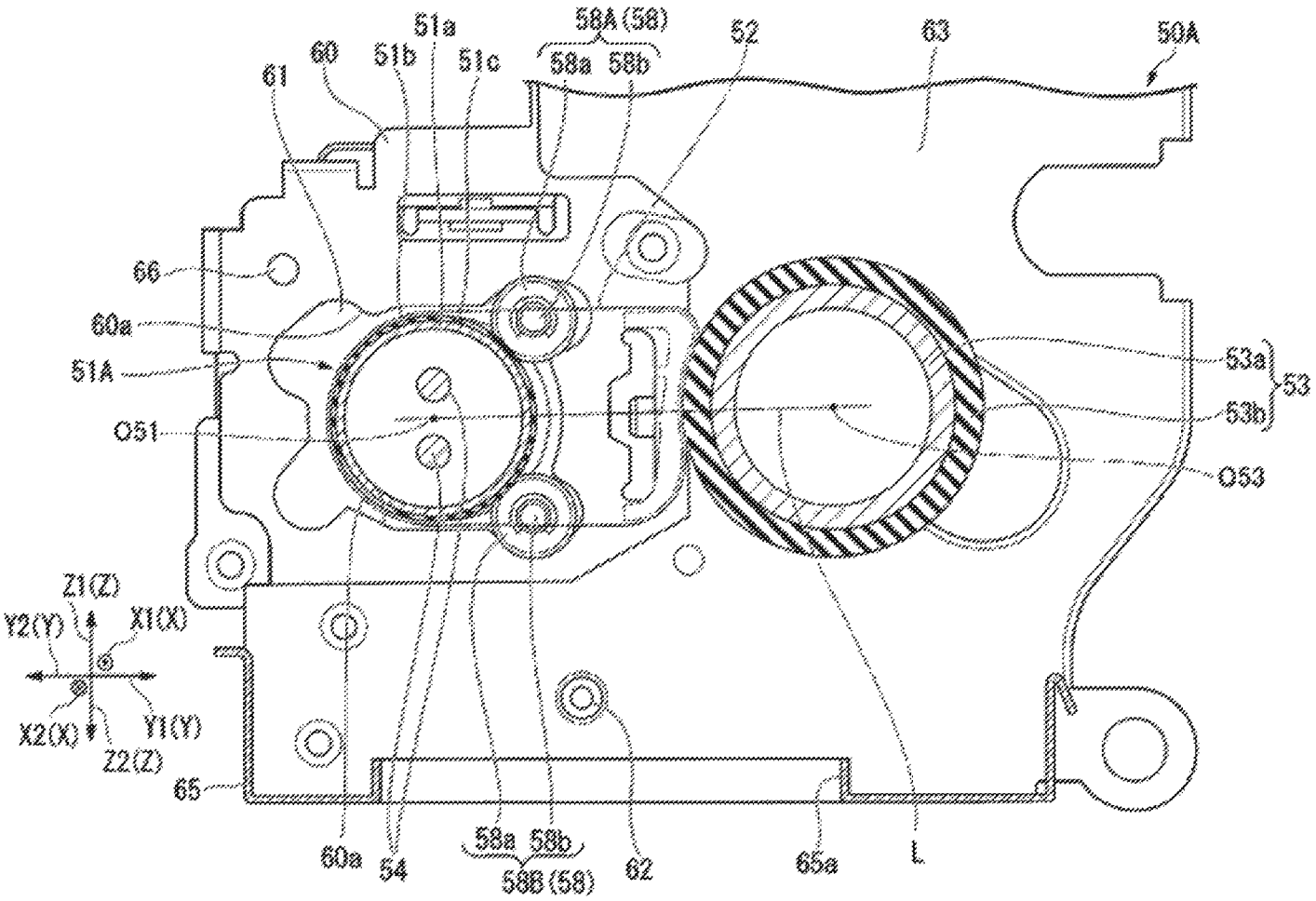
FIG. 4 is a cross-sectional view taken along a line A-A in FIG. 3.
Figure 5:
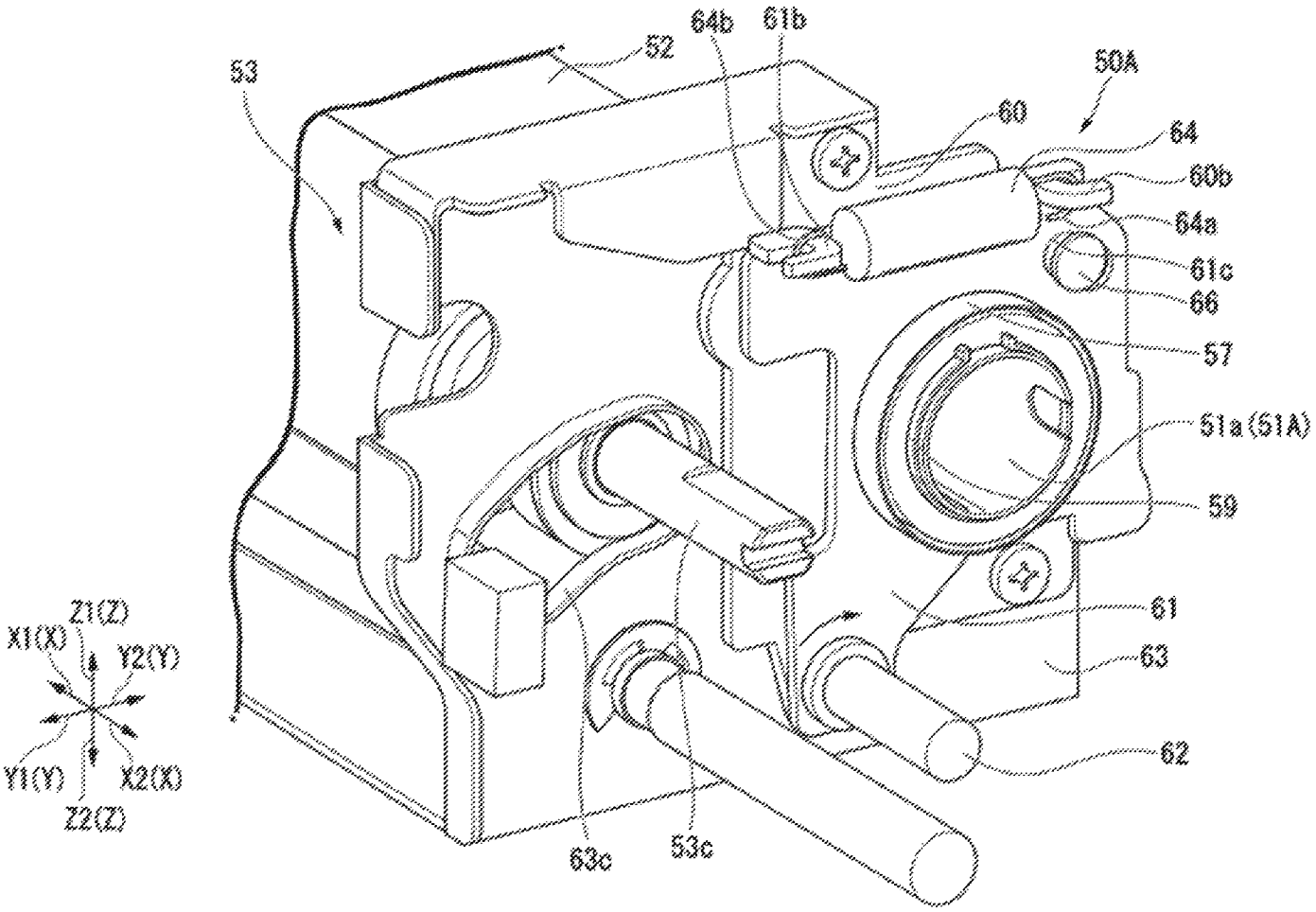
FIG. 5 is a schematic perspective view illustrating a configuration of the fixing device according to the first embodiment.

FIG. 2 is a schematic cross-sectional view illustrating a configuration of the fixing device according to the first embodiment. FIG. 3 is a schematic perspective view illustrating a configuration of the fixing device according to the first embodiment. FIG. 4 is a cross-sectional view taken along a line A-A in FIG. 3. FIG. 5 is a schematic perspective view illustrating a configuration of the fixing device according to the first embodiment.

As shown in FIG. 2, the fixing device 50A has a press roller 53 (pressure roller), a fixing belt 52, a pad 55, a heating roller 51A, a heater 54 and a support roller 58.

FIG. 2 shows main portions in a longitudinal cross section of a central part of the fixing device 50A and main portions on the inner side at the rear side of the fixing device 50A. In FIG. 2, illustration of some members is omitted for the convenience of viewing.

The fixing device 50A is surrounded by a case (not shown). The case is formed with an entrance opening and a discharge opening. The sheet P can enter into the entrance opening. The sheet P can be discharged from the discharge opening.

A conveyance direction of the sheet P entering the fixing device 50A is a direction from the lower side to the upper side in FIG. 2. The entrance opening of the fixing device 50A is arranged at the lower side in FIG. 2. The discharge opening of the fixing device 50A is arranged at the upper side in FIG. 2.

Conveyance guides (not shown) are arranged below the entrance opening and above the discharge opening of the fixing device 50A, respectively.

The press roller 53 is arranged at a position facing the fixing belt 52 described below in a substantially horizontal direction. At both ends of the press roller 53 in the longitudinal direction (X direction), rotating shafts (not shown) extend. Each rotating shaft is coaxially arranged with a central axis O53 of the press roller 53. Each rotating shaft is supported by a contact and separation mechanism (not shown) via a bearing. The press roller 53 is supported to be capable of rotating around the central axis O53 by the contact and separation mechanism.

The contact and separation mechanism are arranged on a first rear side plate 63 and a first front side plate (not shown) of the fixing device 50A. The first rear side plate 63 is one of side plates arranged at the rear end (in the X2 direction) of the fixing device 50A. The first front sideplate is one of side plates arranged at the front end (in the X1 direction) of the fixing device 50A.

The first front sideplate is plane-symmetrical to the first rear side plate 63 with respect to a plane perpendicular to the conveyance orthogonal direction (X direction). The first rear side plate 63 and the first front side plate are connected to the rear end and the front end of a bottom plate 65 extending in the conveyance orthogonal direction, respectively.

An opening 65*a* through which the sheet P can pass is formed on the bottom plate 65.

The contact and separation mechanism supports the press roller 53 in such a manner that a state of the press roller 53 can be switched between a contact state and a separated state. In the contact state, the press roller 53 abuts against the fixing belt 52 described below to press the fixing belt 52. In the separated state, the press roller 53 is separated from the fixing belt 52.

For example, at the time of forming an image, the contact and separation mechanism sets the press roller 53 to the contact state. For example, at the time of handling a jam, the contact and separation mechanism sets the press roller 53 to the separated state in response to an operation performed by the operator.

Holes 63*a* are formed in the first rear side plate 63 and the first front side plate so that the press roller 53 can move between a position in the contact state and a position in the separated state thereof. A rotating shaft 53*c* (refer to FIG. 3, and the front side are not shown) at both ends of the press roller 53 is inserted through the holes 63*a*.

The press roller 53 is supported by the contact and separation mechanism to be capable of rotating in a clockwise direction shown in FIG. 2. The press roller 53 applies pressure to the sheet P from a back surface of the sheet P if the sheet P (refer to a two-dot chain line) reaches a space between the fixing belt 52 described below and the press roller 53 in the contact state described above.

The press roller 53 is energized (in the Y2 direction) towards the fixing belt 52 described below by a spring (not shown) of the contact and separation mechanism.

The press roller 53 has a core 53*a* and an elastic layer 53*b*.

The core 53*a* is a cylindrical member made of metal.

The above rotating shaft 53*c* (the front side is not shown) extend respectively at the both ends of the core 53*a*. The rotating shaft is coaxial with a central axis of the core 53*a*.

The elastic layer 53*b* is laminated in a cylindrical shape on an outer peripheral surface of the core 53*a*. A width of the elastic layer 53*b* in an axial direction of the core 53*a* is wider than the maximum width of the sheet P that can be passed.

The elastic layer 53*b* is made of, for example, a heat-resistant rubber material.

The fixing belt 52 is an endless belt. A belt width of the fixing belt 52 is wider than the maximum width of the sheet P which can be passed.

The fixing belt 52 is made of a heat resistant material having resistance to the heating generated by the heating roller 51A described below.

The outer peripheral surface of the fixing belt 52 is made of a resin material having good releasability with respect to a toner. For example, a fluorine resin may be laminated on the outer peripheral surface of the fixing belt 52.

An inner peripheral surface of the fixing belt 52 is made of a material that is less likely to slip against the surface of the heating roller 51A described below.

As the fixing belt 52, for example, a polyimide substrate whose outer peripheral surface is covered with a PFA (polytetrafluoroethylene) tube may be used.

On the inner side of the fixing belt 52, the pad 55 and the heating roller 51A are arranged.

The pad 55 is arranged at a position facing the press roller 53 in a substantially horizontal direction. The fixing belt 52 is sandwiched between the pad 55 and the press roller 53. The pad 55 is fixed to a stay 56. The stay 56 is installed between a second rear sideplate 60 of the fixing device 50A and a second front side plate (not shown). The second front side plate is plane-symmetrical to the second rear side plate 60 with respect to the plane perpendicular to the conveyance orthogonal direction.

The second rear side plate 60 is fixed to the first rear sideplate 63. The second front side plate is fixed to the first front side plate.

The pad 55 is a member of which a cross-sectional shape shown in FIG. 2 extends in a range longer than the width of the fixing belt 52. A longitudinal direction of the pad 55 is parallel to the longitudinal direction of the stay 56.

The surface of the pad 55 facing the press roller 53 abuts against the inner peripheral surface of the fixing belt 52 in a slidable manner. The surface of the pad 55 facing the press roller 53 is formed by a first convex surface 55*a*, a concave surface 55*b* and a second convex surface 55*c*. The first convex surface 55*a*, the concave surface 55*b* and the second convex surface 55*c* are formed in order along the conveyance direction of the sheet P.

The first convex surface 55*a* is arranged on the upstream side (the lower side in FIG. 2) with respect to the central axis of the press roller 53 in the conveyance direction. The first convex surface 55*a* is a curved surface that bends the fixing belt 52 in the conveyance direction along the surface of the press roller 53. In the example shown in FIG. 2, the fixing belt 52 is bent from the lower side towards the upper side along the surface of the press roller 53 from the substantially horizontal direction by the first convex surface 55*a*.

The cross-sectional shape of the first convex surface 55*a* is an arc shape.

The concave surface 55*b* is a curved surface for making the fixing belt 52 to closely contact the surface of the press roller 53. The concave surface 55*b* is a curved surface having an arc-shaped cross section that is smoothly connected with the first convex surface 55*a* and the second convex surface 55*c* described below. A radius of curvature of the concave surface 55*b* is obtained by adding a thickness of the fixing belt 52 to an outer radius of the press roller 53.

As shown in FIG. 2, in a state in which the press roller 53 is energized towards the fixing belt 52, the outer peripheral surface of the fixing belt 52 that abuts against the press roller 53 is curved along the outer peripheral surface of the press roller 53. The inner peripheral surface of the fixing belt 52 that abuts against the press roller 53 closely contacts the concave surface 55*b*. A nip N in the fixing device 50A is formed between the fixing belt 52 closely contacting the concave surface 55*b* and the press roller 53 facing the concave surface 55*b*.

The second convex surface 55*c* is arranged on the downstream side (upper side in FIG. 2) with respect to the central axis of the press roller 53 in the conveyance direction. The second convex surface 55*c* is a curved surface that bends the fixing belt 52 in a direction away from the press roller 53 from the direction along an outer peripheral surface of the press roller 53. In the example shown in FIG. 2, the second convex surface 55*c* bends the fixing belt 52 in a direction away from the press roller 53 in a substantially horizontal direction.

The cross-sectional shape of the second convex surface 55*c* is an arc shape.

The material of the pad 55 is not particularly limited as long as it is a heat resistant material having resistance to the rise in the temperature of the nip N. In the pad 55, the surface, which includes at least the first convex surface 55*a*, the concave surface 55*b* and the second convex surface 55*c*, is made of a material having a small slide coefficient with the inner peripheral surface of the fixing belt 52. For example, a low friction coating may be applied to the surface of the pad 55 including at least the first convex surface 55*a*, the concave surface 55*b* and the second convex surface 55*c*.

The heating roller 51A is capable of abutting against the inner peripheral surface of the fixing belt 52. The heating roller 51A can heat the fixing belt 52 at the time of abutting against the fixing belt 52. The heating roller 51A is supported to be capable of rotating around a central axis O51 of the heating roller 51A by the support roller 58 described below. A driving force is transmitted from a drive source (not shown) to the heating roller 51A. The heating roller 51A rotates around the central axis O51 upon receiving the driving force. If the heating roller 51A rotates in a state of abutting against the inner peripheral surface of the fixing belt 52, a rotational driving force is transmitted to the fixing belt 52.

As shown in FIG. 3, the heating roller 51A has a core 51*a* (cylindrical portion) and a belt abutting portion 51*b*.

The core 51*a* is a cylindrical member made of metal. For example, the core 51*a* may be made of an aluminum alloy.

An outer peripheral surface 51*c* (cylindrical surface) of the core 51*a* is exposed at both ends in the longitudinal direction of the core 51*a*. A configuration of the rear end in the longitudinal direction of the heating roller 51A is shown in FIG. 3. Although not shown, the outer peripheral surface 51*c* is exposed in the same manner at the front end in the longitudinal direction of the heating roller 51A. Each outer peripheral surface 51*c* is a cylindrical surface coaxial with the central axis O51 of the heating roller 51A. Each outer peripheral surface 51*c* is supported to be capable of rotating around the central axis O51 by the support roller 58 described below. The outer peripheral surface 51*c* that does not abut against the fixing belt 52 may have a diameter slightly smaller than the outer diameter of the heating roller 51A abutting against the fixing belt 52.

The belt abutting portion 51*b* is formed in a cylindrical shape that covers an outer peripheral surface of a central portion in the longitudinal direction of the core 51*a*. A length of the belt abutting portion 51*b* in the longitudinal direction of the core 51*a* is larger than the width of the fixing belt 52. The belt abutting portion 51*b* can abut against the fixing belt 52 over the entire width of the inner peripheral surface of the fixing belt 52. The belt abutting portion 51*b* transmits the rotational driving force from the heating roller 51A to the fixing belt 52. The inner peripheral surface of the belt abutting portion 51*b* closely contacts an outer peripheral portion of the core 51*a*. The outer peripheral surface of the belt abutting portion 51*b* is a cylindrical surface coaxial with the central axis O51.

The belt abutting portion 51*b* transfers the heat applied to the core 51*a* to the fixing belt 52. The belt abutting portion 51*b* transmits the rotation of the core 51*a* to the fixing belt 52.

The material of the belt abutting portion 51*b* requires good thermal conductivity and is capable of obtaining a frictional force for preventing slip with respect to the inner peripheral surface of the fixing belt 52 at the time of rotation.

A belt regulation plate 51*d* stops the fixing belt 52 wound around the belt abutting portion 51*b*. The belt regulation plate 51*d* has an annular shape extending outward in a radial direction and in a periphery direction from the outer peripheral surface of the core 51*a*. The belt regulation plates 51*d* are respectively arranged at two positions adjacent to both ends in the longitudinal direction of the belt abutting portion 51*b*. In FIG. 3, the belt regulation plate 51*d* adjacent to the rear end of the belt abutting portion 51*b* is shown. Although not particularly shown, the belt regulation plate 51*d* is arranged in the same manner at the front end of the belt abutting portion 51*b*.

Each belt regulation plate 51*d* radially protrudes from the outer peripheral surface of the belt abutting portion 51*b*. A height difference between a tip in the radial direction of each belt regulation plate 51*d* and the belt abutting portion 51*b* is larger than a thickness of the fixing belt 52.

Each outer peripheral surface 51*c* described above is adjacent to each belt regulation plate 51*d*.

Each belt regulation plate 51*d* may be formed by the same material as the belt abutting portion 51*b* to be integrated with the belt abutting portion 51*b*. However, each belt regulation plate 51*d* may be formed separately from the belt abutting portions 51*b* using a material different from the belt abutting portions 51*b*. In this case, at least a side surface of the belt regulation plate 51*d* facing the end of the fixing belt 52 is preferably formed by a material having a low slide resistance to the fixing belt 52.

As shown in FIG. 2, the heater 54 is inserted into the inside of the core 51*a* of the heating roller 51A. The heater 54 is a heating source that heats the heating roller 51A.

The configuration of the heater 54 is not particularly limited as long as the heater 54 can heat the core 51*a* from the inside of the core 51*a*. For example, a heating source such as a halogen lamp and the like may be used as the heater 54.

The heater 54 of the present embodiment is constituted by, for example, two halogen lamps. The halogen lamps are respectively supported by support members (not shown) at both ends of the core 51*a*. The halogen lamps are arranged to face each other across the central axis O51.

The light control of each halogen lamp can be performed independently. For example, the fixing device 50A may have a normal fixing mode and a low temperature fixing mode. In the normal fixing mode, both of the two halogen lamps may be turned on. In the low temperature fixing mode, either one of the two halogen lamps may be turned on. For example, the low temperature fixing mode may be used to fix an image developed with the decolorable toner.

A thermistor (not shown) is arranged on at least one of the surface of the heating roller 51A and the surface of the fixing belt 52. The thermistor detects the temperature of at least one of the surface of the heating roller 51A and the surface of the fixing belt 52. The temperature detected by the thermistor is used for temperature control for the heating roller 51A of the fixing device 50A. Specifically, ON/OFF control of the heater 54 is performed based on the temperature detected by the thermistor. The ON/OFF control of the heater 54 is performed so that the temperature of the nip N reaches a predetermined target fixing temperature.

The support rollers 58 rotatably support the heating roller 51A at both ends in the longitudinal direction of the heating roller 51A. The support rollers 58 are arranged at the rear end and the front end of the fixing device 50A, respectively.

The support roller 58 positioned at the rear end is fixed to the rear support plate 61 overlapping with a surface of the second rear side plate 60 facing the X2 direction. The support roller 58 extends in the X1 direction from the rear support plate 61 through the opening 60*a* penetrating in the thickness direction of the second rear side plate 60.

The support roller 58 (not shown) positioned at the front end is fixed to a front support plate (not shown) overlapping with a surface of the second front side plate facing the X1 direction. The support roller 58 extends in the X2 direction from the front support plate through an opening penetrating in the thickness direction of the second front side plate.

The front support plate is plane-symmetrical to the rear support plate 61 with respect to the plane perpendicular to the conveyance orthogonal direction.

The support rollers 58 arranged at the rear end and the front end of the fixing device 50A are plane-symmetrical to each other in shapes and positions with respect to the plane perpendicular to the conveyance orthogonal direction.

The support roller 58 has a first roller 58A and a second roller 58B.

As shown in FIG. 2, the first roller 58A is arranged at a position on the downstream side in the conveyance direction with respect to a straight line L for connecting the central axes O51 and O53 (position away from the straight line L in the Z1 direction) as viewed from the X2 direction. The second roller 58B is arranged at a position on the upstream side in the conveyance direction with respect to the straight line L (a position away from the straight line L in the Z2 direction) as viewed from the X2 direction.

The first roller 58A has a rotation support shaft 58*b* (fixed shaft) and a rotating member 58*a*.

As shown in FIG. 3, the rotation support shaft 58*b* is fixed to the rear support plate 61. The rotation support shaft 58*b* extends in the X1 direction from the rear support plate 61.

The rotating member 58*a* is arranged to be capable of rotating around a central axis of the rotation support shaft 58*b*. The rotating member 58*a* is arranged to be capable of abutting against the outer peripheral surface 51*c* facing the press roller 53 at the rear end of the heating roller 51A.

The external shape of the rotating member 58*a* is a circular shape. The outer diameter of the rotating member 58*a* is smaller than that of the outer peripheral surface 51*c* of the heating roller 51A.

The configuration of the rotating member 58*a* is not particularly limited as long as the rotating member 58*a* is arranged to be capable of rotating around the central axis of the rotation support shaft 58*b*.

For example, the rotating member 58*a* may be a cylindrical member in which a through hole is formed at a center in an axial direction thereof. In this case, the rotating member 58*a* is externally fitted to the through hole to be capable of rotating around the rotation support shaft 58*b*. In this case, the rotating member 58*a* may be a cylindrical roller made of resin that slides well with respect to the rotation support shaft 58*b*.

For example, the rotating member 58*a* may be a rotating bearing having an inner ring externally fitted to the rotation support shaft 58*b* in a non-rotatable manner and an outer ring rotating coaxially with the inner ring.

As shown in FIG. 2, the second roller 58B has the same rotation support shaft 58*b* and rotating member 58*a* as the first roller 58A. However, the rotation support shaft 58*b* of the second roller 58B is different from the rotation support shaft 58*b* of the first roller 58A in that the rotation support shaft 58*b* of the second roller 58B is fixed at a position facing the rotation support shaft 58*b* of the first roller 58A across the straight line L in the rear support plate 61.

The rotation support shaft 58*b* of the second roller 58B also extends in the X1 direction from the rear support plate 61. The rotation support shafts 58*b* fixed to the rear support plate 61 are parallel to each other.

The rotating member 58*a* of the second roller 58B is arranged to be capable of rotating around the central axis of the rotation support shaft 58*b* of the second roller 58B. The rotating member 58*a* of the second roller 58B is arranged to be capable of abutting against the outer peripheral surface 51*c* facing the press roller 53 at the rear end of the heating roller 51A.

FIG. 3 and FIG. 5 show the rear support plate 61 and the heating roller 51A as viewed from mutually different angles from the rear side of the second rear side plate 60.

The second rear side plate 60 is provided with a pivot support shaft 62 and a stopper 66.

The pivot support shaft 62 protrudes from the first rear side plate 63 in the X2 direction. As shown in FIG. 2, the pivot support shaft 62 is arranged at a position away from the straight line L in the Z2 direction. The pivot support shaft 62 is fixed to the first rear side plate 63.

The rear support plate 61 is connected to the pivot support shaft 62 in such a manner that it can pivot around the pivot support shaft 62.

As shown in FIG. 5, the stopper 66 is a rod-like member fixed to the second rear side plate 60. The stopper 66 is arranged at a position facing the pivot support shaft 62 across the heating roller 51A as viewed from the X direction. The stopper 66 protrudes from the second rear side plate 60 in the X2 direction. The stopper 66 is inserted into the inside of an opening 61*c* penetrating through the rear support plate 61.

The opening 61*c*, together with the stopper 66, regulates a pivot range of the rear support plate 61 at the time the rear support plate 61 pivots around the pivot support shaft 62. A size and position of the opening 61*c* are not particularly limited as long as a necessary pivot range for the rear support plate 61 can be obtained. The pivot range of the rear support plate 61 is determined such that each support roller 58 fixed to the rear support plate 61 can contact with and separate from the outer peripheral surface 51*c* and the tension can be applied to the fixing belt 52 at the time of abutting against the outer peripheral surface 51*c*.

For example, FIG. 4 shows a state in which the rotating member 58*a* of each support roller 58 abuts against the outer peripheral surface 51*c* of the heating roller 51A. At this time, the heating roller 51A and the fixing belt 52 are engaged with each other so as to regulate the pivot of the rear support plate 61. However, at this time, there is a room for pivoting further counterclockwise with respect to the state shown in FIG. 4 between the stopper 66 and the opening 61*c*.

As shown in FIG. 5, a hook 60*b* is arranged at the end of the second rear side plate 60 in the Z1 direction. The hook 60*b* is bent in the X2 direction from the end of the second rear side plate 60 in the Z1 direction (refer to FIG. 3). The hook 60*b* protrudes further in the X2 direction with respect to the rear support plate 61. The hook 60*b* is formed with a U-shaped groove for locking a spring 64 described below. The U-shaped groove of the hook 60*b* is opened in the Y2 direction.

At the end of the rear support plate 61 in the Z1 direction, a hook 61*b* is arranged at a position separated from the hook 60*b* in the Y1 direction. The hook 61 *b* is bent in the X2 direction from the end of the rear support plate 61 in the Z1 direction. The hook 61*b* protrudes in the X2 direction with respect to the second rear side plate 60 to the same extent as the hook 60*b*. The hook 61*b* is formed with a U-shaped groove for locking the spring 64 described below. The U-shaped groove of the hook 61*b* is opened in the Y1 direction.

The spring 64 (energization member) is locked in the U-shaped grooves of the hooks 60*b* and 61*b*. The spring 64 pulls the hook 61*b* towards the hook 60*b*. For example, the spring 64 may be a tension coil spring. Locking portions 64*a* and 64*b* are arranged at both ends in the longitudinal direction of the spring 64. The locking portion 64*a* is locked in the U-shaped groove of the hook 60*b*. The locking portion 64*b* is locked in the U-shaped groove of the hook 61*b*.

By locking the spring 64 between the hooks 60*b* and 61*b*, the rear support plate 61 receives a moment of force in the clockwise direction with respect to the pivot support shaft 62 as viewed from the X1 direction.

The core 51*a* at the rear end of the heating roller 51A protrudes in the X2 direction from the rear support plate 61 through the opening (not shown) formed on the rear support plate 61. A gear 57 is fixed to the outer peripheral portion of the core 51*a* protruding from the rear support plate 61. The gear 57 is prevented from falling from the core 51*a* by a stop ring 59.

The gear 57 is connected to a drive source (not shown) via a gear transmission mechanism (not shown). If a driving force from the drive source is transmitted to the gear 57, the heating roller 51A can rotate around the central axis O51.

However, the gear 57 is not arranged at the front end of the heating roller 51A.

The example of a configuration of the rear end of the fixing device 50A is described above. For example, except for differences relating to the absence of the gear 57, the main configuration of the front end of the fixing device 50A is plane-symmetrical to the above-described configuration of the rear end thereof with respect to the plane orthogonal to the conveyance orthogonal direction.

The operation of the image forming apparatus 10 is described with reference to FIG. 1.

The image forming apparatus 10 of the present embodiment forms an image on a sheet P based on the image data input to the printer section 17. The image data is, for example, image data read by the scanner section 15 or image data created by a personal computer or the like.

In the printer section 17, the exposure device 19 respectively irradiates the image forming sections 20Y, 20M, 20C and 20K with the exposure light LY, LM, LC and LK based on image data corresponding to Y, M, C and K colors.

In the image forming sections 20Y, 20M, 20C and 20K, electrostatic latent images are formed on the photoconductive drums 22Y, 22M, 22C and 22K by the exposure light LY, LM, LC and LK, respectively. Developing devices 24Y, 24M, 24C and 24K of the image forming sections 20Y, 20M, 20C and 20K respectively develop electrostatic latent images on the photoconductive drums 22Y, 22M, 22C and 22K using toners in Y, M, C and K colors.

The toner images on the photoconductive drums 22Y, 22M, 22C and 22K are primarily transferred onto the intermediate transfer belt 21 at the respective primary transfer positions by primary transfer rollers 25Y, 25M, 25C and 25K.

Thus, as the intermediate transfer belt 21 moves, the toner images in Y, M, C and K colors that are primarily transferred onto the intermediate transfer belt 21 are stacked.

In parallel with the above image forming operation, the printer section 17 conveys the sheet P.

The sheet P is fed from the sheet feed cassette 18 by the sheet feed mechanism 29. The tip of the sheet P abuts against the registration roller 41 by the sheet feed roller 35. The position of the tip of the sheet P is aligned by the registration roller 41.

Thereafter, the registration roller 41 conveys the sheet P. A conveyance timing of the sheet P by the registration roller 41 is a timing at which the toner image on the intermediate transfer belt 21 and the tip of the transfer area of the toner image on the sheet P simultaneously reach the secondary transfer position.

If the sheet P moves to the secondary transfer position, a secondary transfer voltage is applied to the secondary transfer roller 33. The toner image on the intermediate transfer belt 21 is secondarily transferred onto the sheet P as the secondary transfer roller 33 rotates.

The sheet P on which the toner image is secondarily transferred enters the entrance opening of the fixing device 50A. The sheet P passes through the entrance opening. The toner image on the sheet P is thermally fixed by the fixing device 50A.

Here, an operation performed by the fixing device 50A is described.

Figure 6:
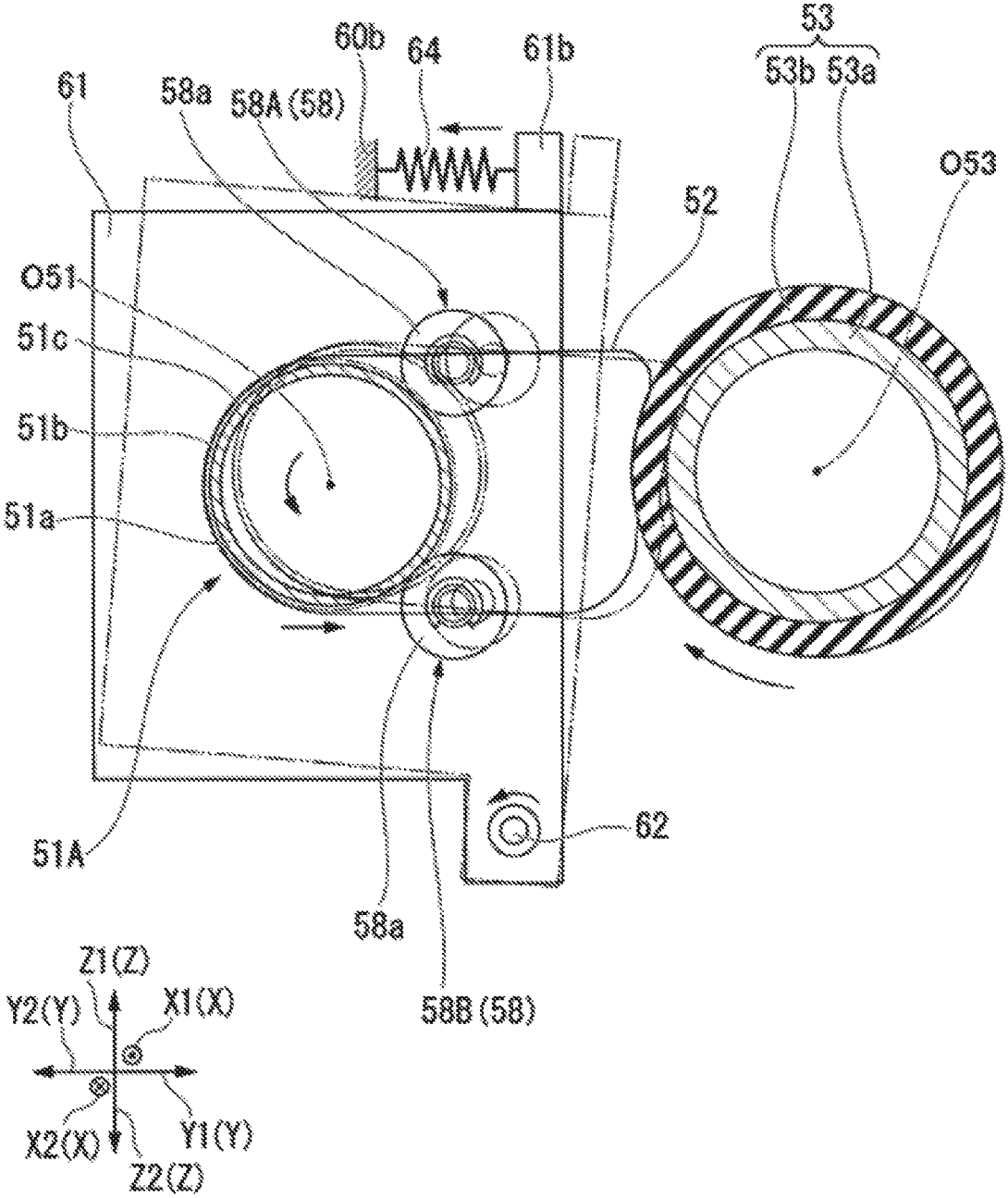
FIG. 6 is a diagram illustrating an operation performed by the fixing device according to the first embodiment.

FIG. 6 is a diagram illustrating an operation performed by the fixing device according to the first embodiment.

In the fixing device 50A, at the time of forming the image, the press roller 53 is in the contact state by the contact and separation mechanism. At this time, as shown in FIG. 2, the press roller 53 presses the pad 55 across the fixing belt 52. The fixing belt 52 is sandwiched between the concave surface 55*b* of the pad 55 and the press roller 53. The nip N is formed between the fixing belt 52 facing the concave surface 55*b* and the elastic layer 53*b* of the press roller 53.

On the other hand, as shown by a solid line in FIG. 6, the spring 64 is locked between the hooks 60*b* and 61*b*. The spring 64 applies a tensile force to the hooks 60*b* and 61*b*. Since the rear support plate 61 provided with the hook 61*b* is capable of pivoting around the pivot support shaft 62, the rear support plate 61 pivots counterclockwise around the central axis of the pivot support shaft 62. The hook 61*b* is pulled towards the hook 60*b*.

The first roller 58A and the second roller 58B fixed to the rear support plate 61 pivot together with the rear support plate 61. The rotating members 58*a* of the first roller 58A and the second roller 58B abut against the outer peripheral surface 51*c* of the heating roller 51A. The heating roller 51A is energized in the clockwise direction shown in FIG. 6 by the first roller 58A and the second roller 58B.

The outer peripheral surface of the heating roller 51A in the Y2 direction closely contacts the inner peripheral surface of the fixing belt 52. The energization force from the spring 64 is transmitted to the fixing belt 52 via the heating roller 51A. As a result, the tension occurs in the fixing belt 52. The tension of the fixing belt 52 can be adjusted according to the magnitude of the tension from the spring 64.

Although not shown in the figure, the front support plate is similarly pivoted at the front end of the heating roller 51A, and thus, the energization force from the spring 64 is transmitted to the fixing belt 52 via the heating roller 51A.

The press roller 53 rotates clockwise around the central axis O53. As the press roller 53 rotates, the heating roller 51A is rotated around the central axis O51 counterclockwise as shown in FIG. 6. Specifically, the driving force is transmitted from the drive source (not shown) to the gear 57 (not shown). The heating roller 51A is rotatably supported by the first roller 58A and the second roller 58B on the outer peripheral surfaces 51*c* at both ends in the X direction thereof.

Since each first roller 58A and each second roller 58B energizes the heating roller 51A in a pivot direction thereof, the heating roller 51A closely contacts the inner peripheral surface of the fixing belt 52. The fixing belt 52 rotates in the same direction as the heating roller 51A by friction with the heating roller 51A.

Therefore, each support roller 58 has a function of a bearing for rotatably supporting the heating roller 51A and a function of applying tension to the fixing belt 52.

If the fixing belt 52 rotates, the heater 54 is turned on, and thus, the temperature control for the fixing belt 52 is started. The light control for the heater 54 is performed such that the temperature of the fixing belt 52 reaches a fixing temperature necessary for fixing the toner image. When the fixing belt 52 is heated to the fixing temperature, the heat necessary for fixing is supplied to the nip N. The sheet P reaching the nip N is heated at the nip N, thereby fixing the toner image to the sheet P.

Thus, the image formation on the sheet P is completed.

Next, the action of the fixing device 50A is described.

According to the configuration of the present embodiment, the rotating member 58*a* of each support roller 58 has a diameter smaller than the outer diameter of the heating roller 51A. Therefore, the configuration of fixing device 50A can be made compact as compared with a case in which the heating roller 51A is supported by externally fitting a bearing having a larger diameter than the heating roller 51A to the heating roller 51A. A lower limit of the outer diameter of the rotating member 58*a* is not particularly limited as long as each support roller 58 has a cylindrical surface capable of being in line contact with the outer peripheral surface 51*c*.

For example, in a case in which the bearing having the larger diameter than the heating roller 51A is used, a large-diameter heat insulating bush is also required. For this reason, in the support plate, a certain annular area on the outer peripheral side of the heating roller 51A is a dead space where no other members can be arranged.

In addition, a through hole much larger than the heating roller 51A in the support plate is required to support such a bearing and a heat insulating bush. Therefore, an area of the support plate is limited, and reinforcement of the support plate is also required.

Contrarily, if the heating roller 51A is supported by the support roller 58, other members can be arranged in a space at the outer side of the heating roller 51A, except for the vicinity of a position where the heating roller 51A and each support roller 58 abut against each other. In particular, in the present embodiment, the support roller 58 is arranged between the heating roller 51A and the pad 55. For this reason, it is easy to arrange other members in the vicinity of the surface in the X2 direction of the heating roller 51A. If it is not necessary to arrange other members, a size of an external shape of the fixing device 50A may be reduced.

In the present embodiment, the through hole of the rear support plate 61 or the like may have such a size that the heating roller 51A can be inserted into the through hole. For this reason, an effective space where members such as the rear support plate 61 can be arranged is enlarged. Furthermore, since the reduction in the strength of the rear support plate 61 and the like is small, a compact configuration without a reinforcement structure is realized.

In the present embodiment, since the large-diameter bearing, the heat insulating bush and the like are not necessary, the cost in members can be reduced. In particular, in a case in which a cylindrical member is used as the rotating member 58*a*, the cost can be significantly reduced as compared with a case in which a rotating bearing having an outer ring and an inner ring is used.

In the present embodiment, since each support roller 58 has a function of applying tension to the fixing belt 52, a tension roller for applying tension to the fixing belt 52 can be omitted. For this reason, the cost in the members can be reduced.

Furthermore, as in the case of applying a tension by the tension roller, it is not necessary to cause the fixing belt 52 to protrude to the outer peripheral side by the tension roller. In this way, since the space for arranging the fixing belt 52 can be reduced, the space can be reduced.

According to the configuration of the present embodiment, the tension of the fixing belt 52 can be decreased by releasing the energization by the spring 64. Since the bearing is not externally fitted to the heating roller 51A, the heating roller 51A can be easily pulled out in the X direction. For this reason, in the present embodiment, an assembling and disassembling work for the heating roller 51A and the fixing belt 52 in the fixing device 50A becomes easier.

As described above, according to the present embodiment, it is possible to provide the fixing device 50A capable of supporting the heating roller 51A with a compact configuration and the image forming apparatus 10 provided with the same.

Second Embodiment

A fixing device of the second embodiment is described.

Figure 7:
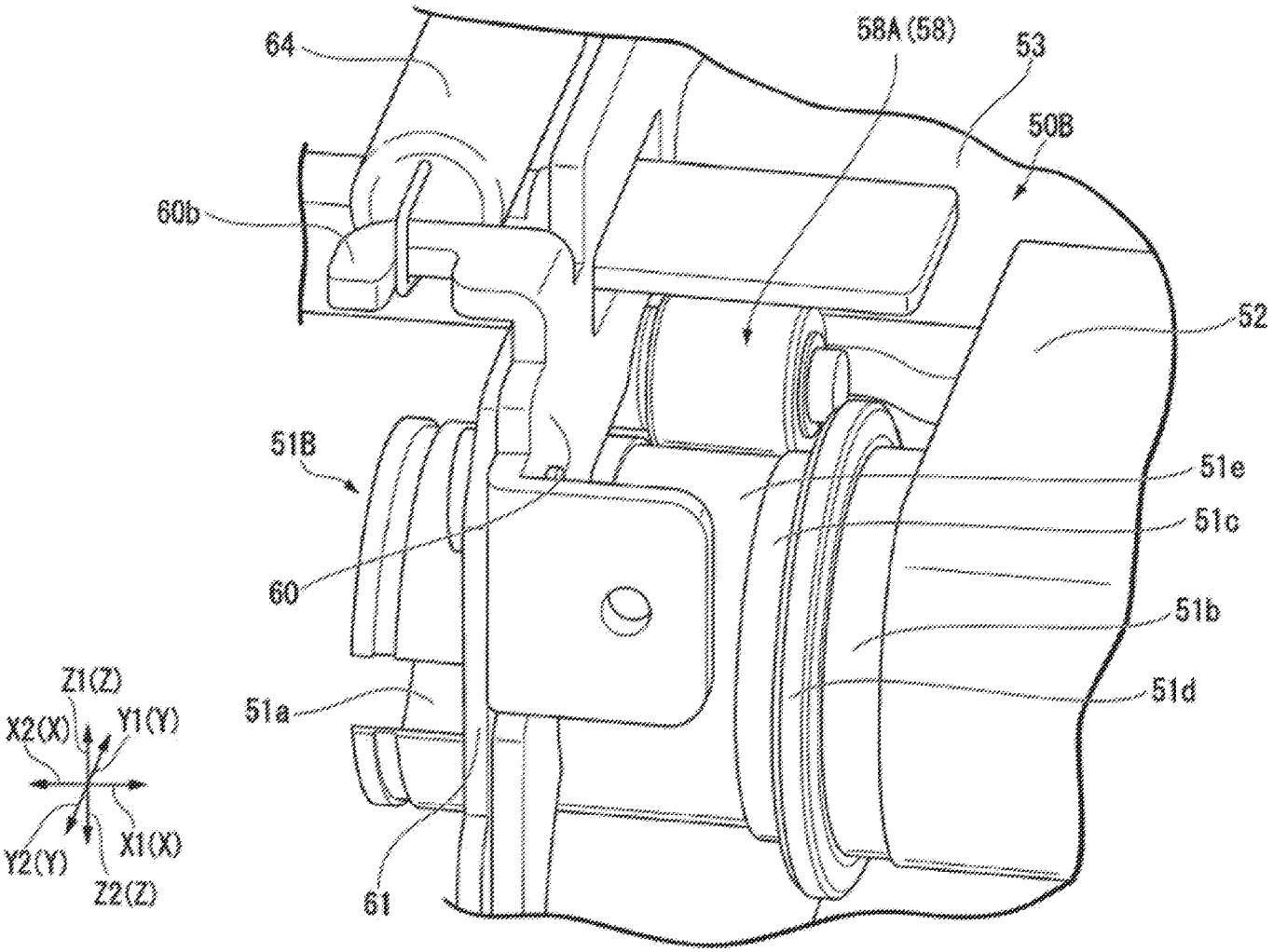
FIG. 7 is a schematic perspective view illustrating a configuration of a fixing device according to a second embodiment.
Figure 8:
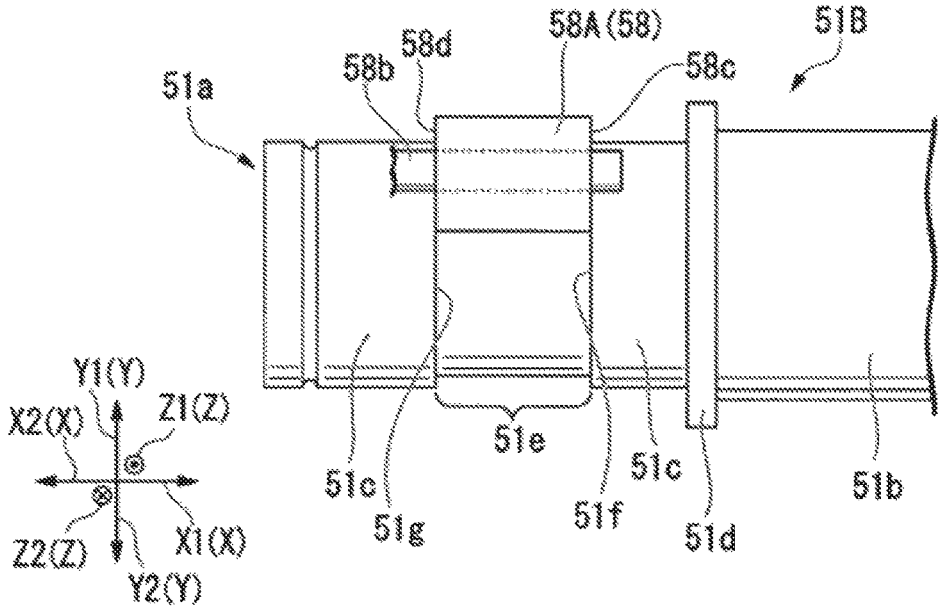
FIG. 8 is a schematic plan view illustrating a configuration of the fixing device according to the second embodiment.
Figure 9:
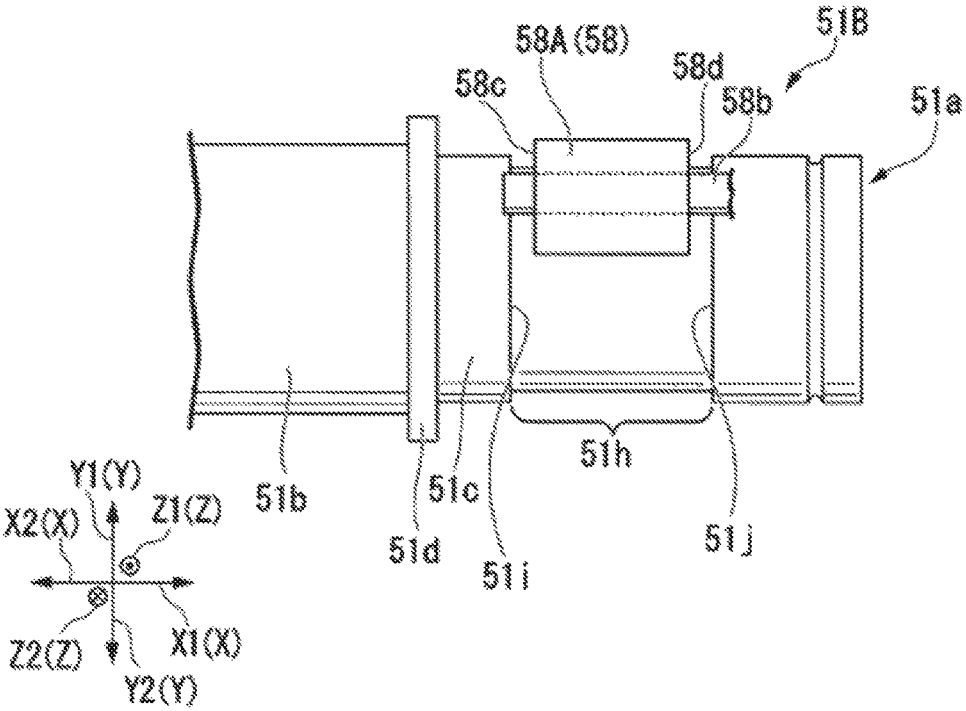
FIG. 9 is a schematic plan view illustrating a configuration of the fixing device according to the second embodiment.

FIG. 7 is a schematic perspective view illustrating a configuration of the fixing device according to the second embodiment. FIG. 8 and FIG. 9 are schematic plan views illustrating a configuration of the fixing device according to the second embodiment.

As shown in FIG. 1, a fixing device 50B of the second embodiment can be used in place of the fixing device 50A in the image forming apparatus 10 of the first embodiment.

As shown in FIG. 2, the fixing device 50B has a heating roller 51B in place of the heating roller 51A of the fixing device 50A. The shape of the longitudinal end of each of the heating roller 51B and the heating roller 51A is different.

Below, differences from the first embodiment are mainly described.

The heating roller 51B has the same configuration as the heating roller 51A except that the heating roller 51B has a guide groove 51*e* and a groove 51*h* on the outer peripheral surface 51*c* at the end of the heating roller 51B in the X2 direction shown in FIG. 7 and FIG. 8 and the end thereof in the X1 direction in FIG. 9.

The guide groove 51*e* is arranged at a position facing each rotating member 58*a* of the support roller 58 provided on the rear support plate 61. The guide groove 51*e* extends in the circumferential direction over the entire circumference of the outer peripheral surface 51*c*. The width in the X direction of the guide groove 51*e* is large enough to be capable of being engaged with a length in the X direction of each rotating member 58*a* of the support roller 58 provided on the rear support plate 61. The depth of the guide groove 51*e* is constant. Therefore, the bottom of the guide groove 51*e* is a cylindrical surface coaxial with the outer peripheral surface 51*c*.

The guide groove 51*e* is engaged with each rotating member 58*a* of the support roller 58 provided on the rear support plate 61 in the X direction. However, in FIG. 7 and FIG. 8, the second roller 58B is not shown. The outer diameter of the bottom of the guide groove 51*e* is not particularly limited as long as the rotating member 58*a* can be engaged with the guide groove 51*e* in the X direction through a height difference with respect to the outer peripheral surface 51*c*. When a groove side surface in the X1 direction and a groove side surface in the X2 direction of the guide groove 51*e* are respectively referred to as a first groove side surface 51*f* and a second groove side surface 51*g*, a width of the guide groove 51*e* is a distance between the first groove side surface 51*f* and the second groove side surface 51*g*. When a side surface in the X1 direction and a side surface in the X2 direction of the rotating member 58*a* are referred to as a first side surface 58*c* and a second side surface 58*d*, respectively, the length of the rotating member 58*a* is a distance between the first side surface 58*c* and the second side surface 58*d*. A difference between the width of the guide groove 51*e* and the length of the rotating member 58*a* is within an allowable movement range of the heating roller 51B in the X direction.

With such a configuration, each rotating member 58*a* of the support roller 58 provided on the rear support plate 61 abuts against the bottom of the guide groove 51*e* in a state in which each rotating member 58*a* is engaged with the guide groove 51*e* in the X direction at the inside of the guide groove 51*e*.

As shown in FIG. 9, the groove 51*h* is arranged at a position facing each rotating member 58*a* of the support roller 58 provided on the front support plate (not shown). The groove 51*h* extends in the circumferential direction over the entire circumference of the outer peripheral surface 51*c*. The width of the groove 51*h* in the X direction is large enough to enable each rotating member 58*a* of the support roller 58 provided on the front support plate to abut against the inside of the groove. The depth of the groove 51*h* is the same as that of the guide groove 51*e*. For this reason, the bottom of the groove 51*h* is a cylindrical surface coaxial with the outer peripheral surface 51*c*.

Each rotating member 58*a* of the support roller 58 provided on the front support plate abuts against the bottom of the groove 51*h*. However, in FIG. 9, the second roller 58B is not shown. When a groove side surface in the X1 direction and a groove side surface in the X2 direction of the groove 51*h* are respectively referred to as a first groove side surface 51*j* and a second groove side surface 51*i*, the width of the groove 51*h* is a distance between the first groove side surface 51*j* and the second groove side surface 51*i*. The width of the guide groove 51*e* is greater than the length of the rotating member 58*a*.

With such a configuration, each rotating member 58*a* of the support roller 58 provided on the front support plate abuts against the bottom of the groove 51*h* in a state in which each rotating member 58*a* is movable relative to the inside of the groove 51*h* in the X direction.

In the present embodiment, since the outer diameter of the groove 51*h* and the outer diameter of the guide groove 51*e* are equal to each other, and the support roller 58 provided on the rear support plate 61 and the support roller 58 provided on the front support plate are plane-symmetrical to each other, the tension generated in the fixing belt 52 is uniform in the X direction.

According to the fixing device 50B of the present embodiment, similar to the fixing device 50A of the first embodiment, each support roller 58 has a function of a bearing that rotatably supports the heating roller 51B and a function of applying tension to the fixing belt 52. Therefore, the fixing device 50B has the same function as the fixing device 50A.

Furthermore, in the present embodiment, the heating roller 51B and each rotating member 58*a* of the support roller 58 provided on the rear support plate 61 are engaged with each other in the X direction. As a result, when the heating roller 51B is driven to rotate, fluctuation in the position of the heating roller 51B in the X direction is suppressed.

As described above, according to the present embodiment, it is possible to provide the fixing device 50B capable of supporting the heating roller 51B with a compact configuration and the image forming apparatus 10 provided with the same.

Third Embodiment

A fixing device of the third embodiment is described below.

Figure 10:
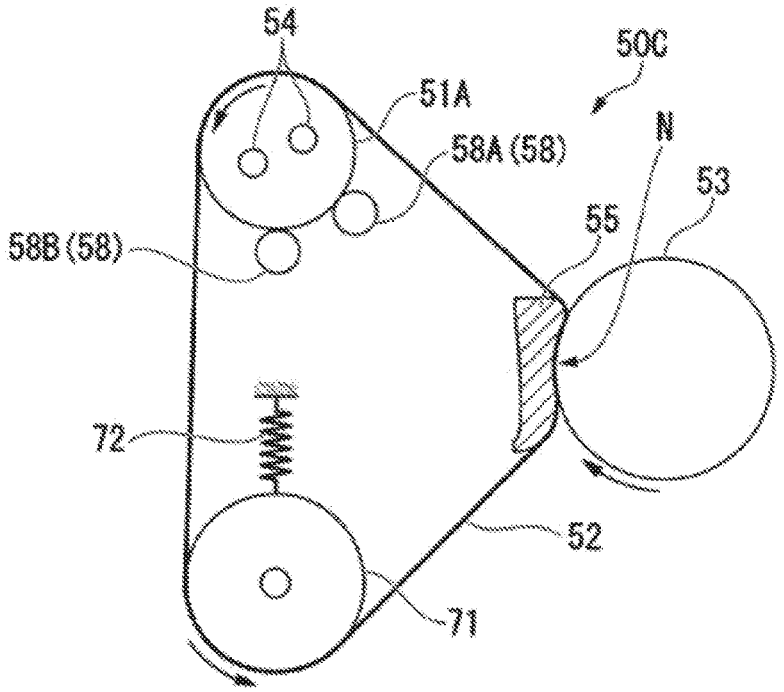
FIG. 10 is a schematic cross-sectional view illustrating a configuration of a fixing device according to a third embodiment.

FIG. 10 is a schematic cross-sectional view illustrating a configuration of the fixing device according to the third embodiment.

As shown in FIG. 10, in a fixing device 50C, a tension roller 71 is added at the inside of the fixing belt 52 of the fixing device 50A. Furthermore, the position of the support roller 58 in the present embodiment is fixed with respect to the second rear side plate 60 and the front side plate (not shown). Therefore, the rear support plate 61, the front support plate and the spring 64 can be omitted.

The fixing device 50C of the present embodiment can be used in place of the fixing device 50A of the image forming apparatus 10 of the first embodiment.

Below, differences from the first embodiment are mainly described.

The tension roller 71 is arranged between the heating roller 51A and the pad 55 in a rotation direction of the fixing belt 52. The tension roller 71 is energized by the spring 72 in a direction from the inside to the outside of the fixing belt 52.

For this reason, in the present embodiment, the tension is applied to the fixing belt 52 by the tension roller 71. Each support roller 58 in the present embodiment has a function of the bearing that rotatably supports the heating roller 51A and does not have the function of applying the tension to the fixing belt 52.

The positions of the heating roller 51A, the tension roller 71 and the press roller 53 in FIG. 10 are merely an example. For example, as in the first embodiment, the heating roller 51A may be arranged to face the press roller 53 in a straight line across the nip N. For example, in FIG. 10, the heating roller 51A and the tension roller 71 may be replaced with each other.

According to the fixing device 50C of the present embodiment, each support roller 58 has a function of the bearing that rotatably supports the heating roller 51A, and the tension roller 71 has the function of applying the tension to the fixing belt 52. Therefore, the fixing device 50C can fix the toner image on the sheet P with the heated fixing belt 52.

As in the first embodiment, in the fixing device 50C of the present embodiment, the support roller 58 has the same function of the bearing that rotatably supports the heating roller 51A.

As described above, according to the present embodiment, it is possible to provide the fixing device 50C capable of supporting the heating roller 51A with a compact configuration and the image forming apparatus 10 provided with the same.

Fourth Embodiment

A fixing device of the fourth embodiment is described below.

Figure 11:
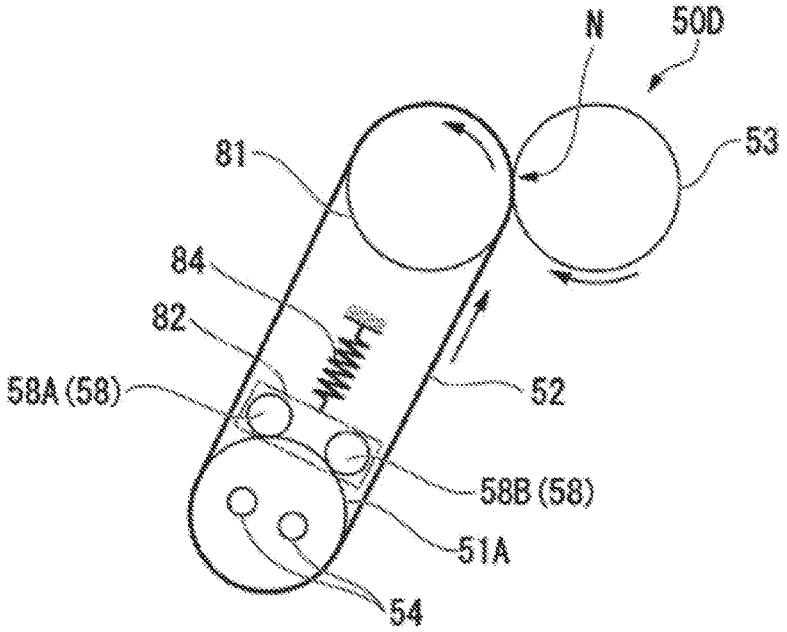
FIG. 11 is a schematic cross-sectional view illustrating a configuration of a fixing device according to a fourth embodiment.

FIG. 11 is a schematic cross-sectional view illustrating a configuration of the fixing device according to the fourth embodiment.

As shown in FIG. 11, a fixing device 50D has a fixed roller 81 instead of the pad 55 of the fixing device 50A. Furthermore, the fixing device 50D has a support plate 82 and a spring 84 (energization member) in place of the rear support plate 61 and the front support plate and the spring 64, respectively.

The fixing device 50D of the present embodiment can be used in place of the fixing device 50A of the image forming apparatus 10 of the first embodiment.

Below, differences from the first embodiment are mainly described.

The fixed roller 81 is arranged to face the press roller 53 across the fixing belt 52 from the inside of the fixing belt 52. The fixed roller 81 is rotated in synchronization with the press roller 53. In the present embodiment, as in the first embodiment, the heating roller 51A may be rotated by a drive source, or may be rotated as the fixing belt 52 rotates. When the heating roller 51A is rotated by the drive source, the heating roller 51A is rotated in synchronization with the fixed roller 81 and the press roller 53.

The fixed roller 81 has a hard external surface compared with the press roller 53. Therefore, if the press roller 53 is pressed by the fixed roller 81, the elastic layer 53*b* (refer to FIG. 2) of the press roller 53 is deformed to form the nip N.

Each support plate 82 is energized by the spring 84. The energization direction by the spring 84 is not particularly limited as long as it can apply the tension to the fixing belt 52. Specifically, the energization direction is a direction in which each support roller 58 on each support plate 82 moves the heating roller 51A away from the fixed roller 81.

In the example shown in FIG. 11, a fixed support end of the spring 84 is fixed between the heating roller 51A and the fixed roller 81. In this case, the spring 84 is a compression spring or the like. For example, the fixed support end of the spring 84 may be positioned to face the fixed roller 81 across the heating roller 51A. In this case, for example, the spring 84 may be a tension spring.

However, the energization direction by the spring 84 is not particularly limited for the press roller 53. For example, in the example shown in FIG. 11, the energization direction is a direction away from the fixed roller 81 in a first opposing direction between the heating roller 51A and the fixed roller 81 and intersects with a second opposing direction between the fixed roller 81 and the press roller 53. In this case, a size of the fixing device 50D in the second opposing direction can be reduced as compared with a case in which the first opposing direction and the second opposing direction are the same directions.

As described above, each support roller 58 in the present embodiment has the function of the bearing that rotatably supports the heating roller 51A and the function of applying the tension to the fixing belt 52, as in the first embodiment.

According to the fixing device 50D of the present embodiment, the toner image on the sheet P can be fixed by the heated fixing belt 52 as in the first embodiment.

The fixing device 50D of the present embodiment has the same function as that of the first embodiment.

As described above, according to the present embodiment, it is possible to provide the fixing device 50D capable of supporting the heating roller 51A with a compact configuration and the image forming apparatus 10 provided with the same.

In each of the above embodiments, two support rollers abutting against the heating roller in the circumferential direction thereof are described. However, the number of the support rollers in the circumferential direction is not particularly limited as long as there are plural support rollers. For example, the heating roller may be supported by three or more support rollers arranged at different positions in the circumferential direction.

In each of the above embodiments, the energization member is the tension spring or the compression spring. However, the energization member is not limited to the tension spring or the compression spring. For example, the energization member may be a spring such as a leaf spring, a torsion spring or the like. For example, the energization member may be made of an elastic member capable of generating an elastic restoring force as appropriate. For example, an elastic member suitable for the energization member may be an elastic member such as metal, resin, rubber or the like, or an elastic member formed by a combination of two or more types of elastic members.

In the second embodiment described above, the heating roller 51B has the guide groove 51*e* at the end in the X2 direction and the groove 51*h* at the end in the X1 direction. However, the positions of the guide groove 51*e* and the groove 51*h* may be reversed.

Furthermore, if a pressing force transmitted from each support roller 58 to the heating roller 51B is equal at both ends in the X direction, the groove 51*h* may be omitted. For example, if the groove 51*h* is omitted in the second embodiment, an amount of tension of the spring 64 at the end in the X1 direction is increased by a depth of the groove 51*h*. Therefore, the heating roller 51B receives a larger pressing force at the end in the X1 direction with respect to the end in the X2 direction. If a difference in such pressing forces is beyond an allowable range, for example, a spring constant of the spring 64 at the end in the X1 direction may be changed, or the outer diameter of the rotating member 58*a* at the end in the X1 direction may be reduced by the depth of the groove 51*h*.

If the groove 51*h* is omitted, the external shape of the heating roller 51B becomes simple. For this reason, the cost in the members of the heating roller 51B can be reduced.

In the above embodiments, for the convenience of description, the support roller, the energization member, the rear support plate 61, the front support plate, etc. each have a plane-symmetrical shape with respect to the plane orthogonal to the conveyance orthogonal direction. However, as long as the heating roller can be rotatably supported and the necessary tension can be applied to the fixing belt, the shape, the position, and the like of each member at both ends in the X direction may not be set in the plane-symmetrical manner.

According to at least one embodiment described above, it is possible to provide the fixing device that can support the heating roller in a compact configuration and the image forming apparatus provided with the same.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device, comprising:

a fixing belt configured to heat a toner image on a sheet to which the toner image is attached to fix the toner image to the sheet;

a heating roller, arranged to contact an internal section of the fixing belt to carry the fixing belt, the heating roller configured to heat the fixing belt; and a plurality of support rollers each configured to abut against a portion of the heating roller that does not contact the fixing belt at an end in a longitudinal direction of the heating roller to support the heating roller, the plurality of support rollers having an outer diameter smaller than an outer diameter of the portion of the heating roller that does not contact the fixing belt.

2. The fixing device according to claim 1, further comprising:

an energization member configured to energize the plurality of support rollers, wherein the heating roller receives an external force from the plurality of support rollers energized by the energization member to press the fixing belt so that a tension is generated in the fixing belt.

3. The fixing device according to claim 1, further comprising:

a pressing roller, arranged on an outer peripheral side of the fixing belt, the pressing roller configured to apply pressure to the fixing belt; and a pad, arranged at a position facing the pressing roller to externally contact the fixing belt, the pad configured to form a nip between the fixing belt and the pressing roller by sandwiching the fixing belt between the pad and the pressing roller.

4. The fixing device according to claim 3, wherein the pad has a cross-sectional shape extending longer than a width of the fixing belt.

5. The fixing device according to claim 2, further comprising:

a pressing roller, arranged on an outer peripheral side of the fixing belt, the pressing roller configured to apply pressure to the fixing belt; and a pad, arranged at a position facing the pressing roller to externally contact the fixing belt, the pad configured to form a nip between the fixing belt and the pressing roller by sandwiching the fixing belt between the pad and the pressing roller.

6. The fixing device according to claim 1, wherein the heating roller has a guide groove extending in a circumferential direction thereof, the guide groove positioned at the portion of the heating roller that does not contact the fixing belt, and the plurality of support rollers are engaged with the guide groove in an axial direction of the heating roller.

7. The fixing device according to claim 1, wherein each support roller comprises a rotation support shaft inside a rotating member.

8. The fixing device according to claim 7, wherein an external shape of the rotating member is a circular shape, and an outer diameter of the rotating member is smaller than an outer diameter of an outer peripheral surface of the heating roller.

9. The fixing device according to claim 7, wherein the rotating members of the plurality of support rollers contact the outer peripheral surface of the heating roller.

10. The fixing device according to claim 1, wherein the plurality of support rollers comprises two support rollers and each support roller is configured to rotatably support the heating roller and apply tension to the fixing belt.

11. An image forming apparatus comprising a fixing device, wherein the fixing device comprises:

a fixing belt configured to heat a toner image on a sheet to which the toner image is attached to fix the toner image to the sheet;

a heating roller, arranged to contact an internal section of the fixing belt to carry the fixing belt, the heating roller configured to heat the fixing belt; and a plurality of support rollers each configured to abut against a portion of the heating roller that does not contact the fixing belt at an end in a longitudinal direction of the heating roller to support the heating roller, the plurality of support rollers having an outer diameter smaller than an outer diameter of the portion of the heating roller that does not contact the fixing belt.

12. The image forming apparatus according to claim 11, further comprising:

an energization member configured to energize the plurality of support rollers, wherein the heating roller receives an external force from the plurality of support rollers energized by the energization member to press the fixing belt so that a tension is generated in the fixing belt.

13. The image forming apparatus according to claim 11, further comprising:

a pressing roller, arranged on an outer peripheral side of the fixing belt, the pressing roller configured to apply pressure to the fixing belt; and a pad, arranged at a position facing the pressing roller to externally contact the fixing belt, the pad configured to form a nip between the fixing belt and the pressing roller by sandwiching the fixing belt between the pad and the pressing roller.

14. The image forming apparatus according to claim 13, wherein the pad has a cross-sectional shape extending longer than a width of the fixing belt.

15. The image forming apparatus according to claim 12, further comprising:

a pressing roller, arranged on an outer peripheral side of the fixing belt, the pressing roller configured to apply pressure to the fixing belt; and a pad, arranged at a position facing the pressing roller to externally contact the fixing belt, the pad configured to form a nip between the fixing belt and the pressing roller by sandwiching the fixing belt between the pad and the pressing roller.

16. The image forming apparatus according to claim 11, wherein the heating roller has a guide groove extending in a circumferential direction thereof, the guide groove positioned at the portion of the heating roller that does not contact the fixing belt, and the plurality of support rollers are engaged with the guide groove in an axial direction of the heating roller.

17. The image forming apparatus according to claim 11, wherein each support roller comprises a rotation support shaft inside a rotating member.

18. The image forming apparatus according to claim 17, wherein an external shape of the rotating member is a circular shape, and an outer diameter of the rotating member is smaller than an outer diameter of an outer peripheral surface of the heating roller.

19. The image forming apparatus according to claim 17, wherein the rotating members of the plurality of support rollers contact the outer peripheral surface of the heating roller.

20. The image forming apparatus according to claim 11, wherein the plurality of support rollers comprises two support rollers and each support roller is configured to rotatably support the heating roller and apply tension to the fixing belt.

* * * * *